United States Patent [19]

Schoch

[11] Patent Number: 4,918,956

[45] Date of Patent: Apr. 24, 1990

[54] MONITORABLE AND COMPENSATABLE FEEDBACK TOOL AND CONTROL SYSTEM FOR A PRESS USING A SOLID TOOL BACKUP ELEMENT

[75] Inventor: Daniel A. Schoch, Minster, Ohio

[73] Assignee: The Minster Machine Company, Minster, Ohio

[21] Appl. No.: 304,185

[22] Filed: Jan. 30, 1989

Related U.S. Application Data

[63] Continuation-in-part of Ser. No. 90,215, Aug. 27, 1987.

[51] Int. Cl.[5] ..... B21D 37/10; B21J 9/20; B21J 13/00

[52] U.S. Cl. ..... 72/21; 72/446; 72/452

[58] Field of Search ..... 72/1, 19–21, 72/12, 34, 37, 446, 448, 452, 453.14, 465, 466; 267/119, 130; 100/257

[56] References Cited

U.S. PATENT DOCUMENTS

| | | | |
|---|---|---|---|
| 1,745,549 | 2/1930 | Marghitan . | |
| 3,028,531 | 4/1962 | Heiberger et al. | 318/29 |
| 3,366,086 | 1/1968 | Fraze | 113/121 |
| 3,914,975 | 10/1975 | Kawano | 72/453.13 X |
| 3,948,077 | 4/1976 | Bothe | 72/450 X |
| 4,308,735 | 1/1982 | Nishi | 72/21 |
| 4,386,304 | 5/1983 | Bergmann et al. | 318/561 |
| 4,565,081 | 1/1986 | Massee | 72/19 |
| 4,592,220 | 6/1986 | Martinez et al. | 72/16 |
| 4,593,547 | 6/1986 | Heiberger | 72/1 |
| 4,599,887 | 7/1986 | Asai et al. | 72/453.13 |
| 4,635,466 | 1/1987 | Seki et al. | 72/453.13 |
| 4,667,496 | 5/1987 | Asai et al. | 72/20 |
| 4,698,991 | 10/1987 | Kirii et al. | 62/21 |

FOREIGN PATENT DOCUMENTS

| | | | |
|---|---|---|---|
| 0059432 | 9/1982 | European Pat. Off. | 72/453.13 |
| 227058 | 9/1985 | German Democratic Rep. | 72/453.13 |
| 227349 | 9/1985 | German Democratic Rep. . | |
| 1011296 | 4/1983 | U.S.S.R. | 72/34 |

*Primary Examiner*—E. Michael Combs
*Attorney, Agent, or Firm*—Jeffers, Hoffman & Niewyk

[57] ABSTRACT

A load control system and tool arrangements are disclosed for controlling the shutheight and back-up load on a mechanical press tool in response to a monitored or measured parameter indicative of press tool force or part quality, which monitored parameter is communicated to a controller for determination of a control signal to control a means for regulating the press tool back-up load and shutheight without interrupting press operations. The control system is operable to control a single station or multi station press and can be installed on either an individual press tool or the bolster or slide. The back-up load is controlled by a non-fluid, moveable mechanical tool back-up mechanism.

8 Claims, 5 Drawing Sheets

MONITORABLE AND COMPENSATABLE FEEDBACK TOOL AND CONTROL SYSTEM FOR A PRESS USING A SOLID TOOL BACKUP ELEMENT

CROSS-REFERENCE TO RELATED APPLICATION

This is a continuation-in-part of Application Ser. No. 090,215, filed Aug. 27, 1987. The disclosure of said application is expressly incorporated herein by reference.

BACKGROUND OF THE INVENTION

The present invention relates to mechanical presses, and in particular to a monitorable, feedback controllable tool system for the dies and tool sets of the presses. More specifically, the tool and control system are operable and adaptable to dynamically adjust a single tool, the complete die set or the individual tool station of a multi-station die set to maintain the dimensional tolerances and thus the quality of the parts produced on the press.

Mechanical presses, such as straight side presses and gap frame presses for stamping and drawing, generally comprise a frame having a crown, a bed and a slide supported within the frame for reciprocal motion toward and away from the bed. The slide may be driven by a crankshaft and a connecting arm connected to the slide, to which is mounted the upper die. The lower die is mounted on a bolster connected to the bed. Mechanical presses are widely used for blanking and drawing operations, and vary substantially in size and available tonnage depending upon the intended use. The present invention is particularly well suited to, but not exclusive to, a conversion press for forming easy open beverage can ends where precise control of dimensional tolerances of certain operations, such as embossing and scoring, is critical. This precision dimensional control is required without using the excess tonnage (force) currently provided with the use of oversize kiss blocks in the tooling. The invention is also useful with other types of presses.

Many presses are operable with single or multiple tooling stations and this tooling or the part formed therefrom may vary during operation either from tool wear, temperature changes, or stock material variations. These variations or changes in parameters may cause distortions and/or dimensional variations in the parts produced or formed on the presses. Therefore, it is necessary to continuously monitor the parts produced and to alter or adjust the tooling and press to maintain production of acceptable or quality parts. This quality control function frequently necessitates removal of the dies or tools or some components thereof from the press and subsequent readjustment of the press for production of quality parts. Current industry practice is to provide the readjustments with the press in a static or non running condition, which may not incorporate the thermal and/or speed effects into the adjustment.

Presses, both the mechanical and hydraulic type, have been provided with various arrangements to attempt to accommodate variations in parameters associated with press operations. Included among these adjusting arrangements are die cushions, wherein a hydraulic fluid behind the tooling or die, generally the lower die arrangement, provides a hydraulic cushion. Other efforts at tool control included mechanically operated hydraulic systems, and hydraulic overload control systems, which accommodate or are operable to a maximum load exerted upon the die by the slide during the work stroke. The overload control systems only provide a means to stop the press in case of an overload.

Adjustment means for the press or tools have been devised to be responsive or operable as a function of the stroke frequency. In some cases the adjustments were based upon constant immersion depth of the upper tooling and its adjustment during press operation. Shut height adjustment by an electrical motor drive has been provided by sensing the shutheight on the fly, stopping the press and adjusting the slide in response to the monitored shutheight. However, the initial shutheight had to be known for comparison. Also known is adjustment of the shutheight provided by adjusting a hydraulic bolster control system, which adjusts the bolster, and consequently all tool stations simultaneously to a fixed height to thus adjust the shutheight.

A known lower tool control system utilizes mechanical springs for controlling the pressure on the work piece. However, no monitoring circuit is known for continuously testing the tooling load, comparing the tooling load to an optimum tool load, providing a feedback signal based on this comparison and adjusting individual tools to the optimal tool load. One instance of an attempt to control a forming force for a tool was provided in the case of a roll forming operation, where a controller-force detector is connected for determining the force exerted on a forming roller. The detector utilizes a contact arm for determining the position of the lower slide and through a look-up table compares force versus position relationships for control of the forming roll. This tool position is then compared to known force/position values for adjustment of the tooling in response to this change.

One prior art technique for tool or die adjustment varied the hydraulic pressure of a hydraulically supported, drop away bolster, which adjustment modified the back-up force and, consequently, the bolster component elongation and the operating shutheight of the press. The bolster used is described in U.S. Pat. No. 4,206,699. However, modifying the bolster pressure in this manner increases the force on the entire bolster and changes the shutheight, but in the case of multiple die station presses, the shutheight is changed for all stations, whether needed or not. Furthermore, this system is not automatic in that it relies on an inspection or monitoring of the produced parts and then manual adjustment of the press.

Historically press tooling has generally been set up or assembled by a trial and error type method. That is, the tooling would be installed in the press or, alternatively, a die was set up externally to the press and positioned in the press and the initial parts produced by the press and tool arrangement are tested or checked to determine if they are in the specification limits. The tooling and/or press are then manually adjusted to produce an acceptable part. The adjustments could be in the form of shutheight variation; shimming of the tools; in the case of multiple lane, progressive die arrangements, shimming of individual tooling stations in the die, or shimming the die set; and grinding of tools or a combination of such adjustments.

In a multiple lane progressive die arrangement, such as in a conversion press, the variation of a single tool station usually influences the remaining stations within a lane of the tool arrangement and, in fact, may influence the other lane or lanes by affecting the tipping moment within the die arrangement. Accordingly, the adjustment of the tooling to bring the operation at one of the die stations into specification limits may cause the other die stations to go out of specification.

In the lead frame press industry, the initial shutheight can be adjusted or zeroed and thereafter varied to attain the upper or lower limit of an acceptable or quality part. The selection of an initial setting may be determined by past operating practices and set to accommodate known variations based upon the above variable parameters including press speed (rpm or frequency) and thermal effects on operating shutheight. Further, changes in the part quality can, as noted earlier, vary with changes in the stock material dimensions from specifications. Variation in stock material thickness or hardness influences quality part production from a press or forming arrangement and affects the required forming load and press operation. Although stock variation is not a change in the press or tooling, it must be accommodated to maintain part production within specification limits.

Accommodation of the variations in tooling and/or press parameters while maintaining acceptable or quality part production has led to the practice of utilizing "kiss blocks", particularly in the can conversion industry for multi-lane progressive die arrangements. The kiss block is a massive positive stop block with a compressive resistance or stiffness greater than the stiffness of the press and is used to limit slide travel. The kiss block can be a single block or multiple blocks generally mounted within the tool area between the slide and bolster with a significant cross-sectional area. The kiss blocks thus define the minimum separation at bottom dead center between the upper and lower dies. Therefore, even if the press is sped up or there is a change in the thermal equilibrium, which generally causes elongation or thermal expansion of the mechanical connections and thus less separation between the tools than in their unrestrained state, the kiss blocks limit further shutheight change of the press. However, the use of oversized kiss blocks to limit the travel of the slide can produce very severe stresses and loads on the press. Typically in the conversion industry, when it is determined that the score line depth is insufficient, the load on the press is increased by decreasing the operating shutheight, but limiting the travel of the upper tooling through the use of kiss blocks. The press experiences a mechanical over-travel condition, however, and the tools will continue to travel only to the limit of the kiss block deflection, which maintains the part dimensional specifications. This practice puts a severe strain upon the press frame, and results in an excess work function by the press, which work or energy is not applied to nor required for formation of the stock material to its finished shape. Therefore, this practice results in lower press life; more frequent press breakdowns, which implies less press reliability; and, in addition, requires recess energy not applied to product formation.

Indicative of the above problems is that condition which is found in the can-end industry, particularly for the production of ecologically acceptable can ends or can ends with tear tabs. The press arrangements are generally multi lane, multi station arrangements that are subject to very close tolerances and high volume production rates. Thus it can be appreciated that these high volume rates require high-speed press operation, which results in relatively high or elevated temperature on the tool and pres elements. The stock material is relatively thin but will vary in thickness and/or hardness during the production run. High rate press operation results in tool wear, which may result from erosion, jamming a t a particular tool station or any other condition which changes the profile and dimension of the tool. These end conversion tools are typically reset on an individual tool station basis, whereas progressive dies are typically removed from the press and rebound as a unit. The problem with replacing only one worn tool is that the remaining tools will also have experienced wear. Replacement of a worn or broken tool with a new tool, therefore, can disrupt or disturb the load balance in the die set, causing a potential loss of overall part quality and production.

SUMMARY OF THE INVENTION

Therefore, it has been found that a tool control arrangement which allows adjustment of the tools, either as a group or individually, without their removal or stoppage of the press operation, and accommodates changes in the shutheight would minimize down time, assist in reducing the setup time, reduce excess press load and thus ensure quality part production during continuous press operation. This goal is enhanced by a system which continuously monitors tool performance to maintain the optimal back-up load or operating shutheight without stopping the press.

The present invention, in one form thereof, overcomes the disadvantages inherent in the prior art by providing a tooling arrangement and control circuit for continuous tool load adjustment of press tooling in response to a continuously measured or monitored parameter, such as tool load, during operation of the press. The sensed or monitored parameter is communicated to a calibrated display device and controller, which is operable to provide a control signal to adjust the back-up force on the tooling or the individual tool station shutheight. The constant load is dynamically controllable, either manually or automatically based upon a sensed signal indicative of the tooling load or dimensional part measurement. The tooling is adjustable, either by the constant load device or manually, to maintain the load or shutheight at the optimal value.

Continuous monitoring of any parameter related to the tooling load provides a means of monitoring the quality of parts produced o the press. The tool force or load may be correlated to the part quality or specifications initially produced from the tooling, which calibrated force may be from empirical data or calculated from known parameters. Monitoring and dynamic adjustment of tooling load or related parameters during operation of the press provides quality part production without press stoppage or operator intervention.

In one form of the invention, the lower tooling is supported against the force of the movable and/or adjustable tooling by a solid tool back-up device connected to the lower tooling. The back-up force may be provided by an adjustable lower tool holder acting against a preloaded spring, and the force acting against the lower tooling is maintained very accurately at an optimal level. In one of the preferred forms of the invention, a comparator or microprocessor monitors the back-up force and continually compares the force with a reference value of desired or optimal back-up force. The output of the comparator then controls a motor driven wedge device, for example, which maintains the back-up pressure precisely at the optimally required reference level. Furthermore, the reference back-up force level set into the microprocessor or comparator can be varied depending on measurements obtained from monitoring part quality as the press operates. For example, the score residual on an easy open can end in a conversion press can be manually or automatically measured, and the back-up force parameter appropriately increased or decreased as the scoring penetration decreases and increases, respectively. The amount of back-up force on the tool can be measured directly by means of a load cell strain gage transducer, for example.

The invention is particularly adaptable to a multiple die station press by providing an independently controllable back-up force for each of the die stations. Separate load cells are provided for each of the back-up cylinders, and the back-up loading is independently monitored for each of the stations and adjusted as needed. The advantage to this arrangement is that if a particular die station tooling would wear at a premature rate, the back-up force would remain constant, thereby compensating for the wear without affecting the loading and effective shutheight of the other tooling stations within the die set. Similarly, tool wear conditions requiring tool force increase can be accommodated with dynamic adjustment of the individual die station. Independent feed back systems could be provided for each of the die stations or any combination of stations could be equally adjusted, so that the part quality resulting from die operations at individual stations or closely related groups of stations can be monitored and the back-up force independently adjusted for the various die or group of die stations.

BRIEF DESCRIPTION OF THE DRAWINGS

In the figures of the drawings, like reference numerals identify like components, and in the drawings.

DESCRIPTION OF THE PREFERRED EMBODIMENT

Figure 1:
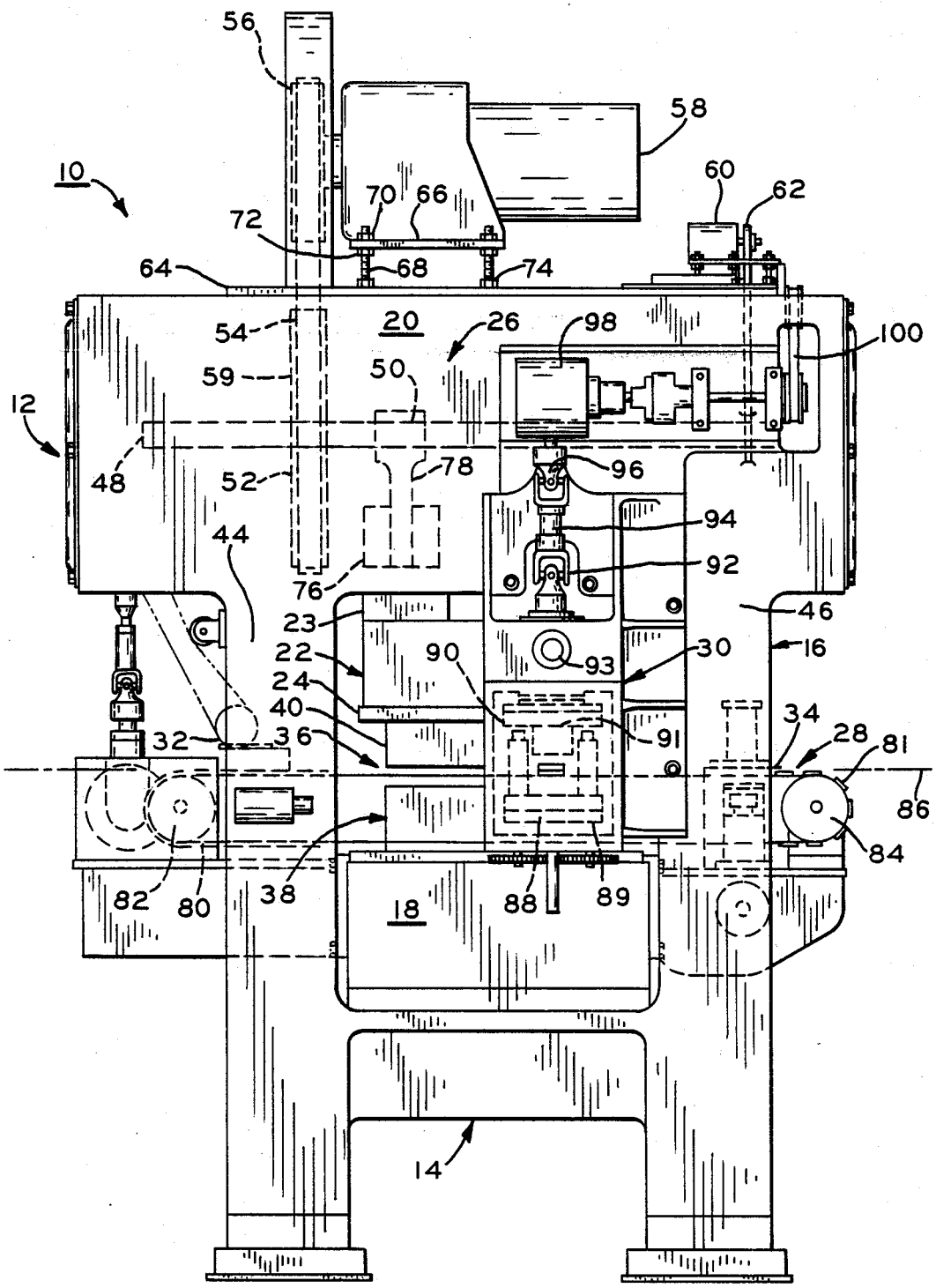
FIG. 1 is an elevational view of an exemplary press assembly incorporating the present invention.

The present invention provides a monitor and feedback control system and a dynamically adjustable tool arrangement for a press, for example, the tooling and press 10 shown in FIG. 1. Press assembly 10 comprises a main press 12 including a bed 14, a frame 16, a quick-open bolster 18 and a crown 20 vertically positioned above bed 14 and quick-open bolster 18. Slide 22 and slide plate 24 are coupled to and operable by drive assembly 26 mounted in crown 20. Press assembly 10 includes a belt transfer conveyor 28 for he transfer of workpieces, such as can ends, and a tab press 30 mounted on the frame and laterally displaced from the transfer conveyor. Can end blanks are provided through a downstacker 32 and an upstacker 34 is mounted on press 12 for ejection of formed can ends from belt 28. Downstacker 32 and upstacker 34 are located at opposite ends of transfer belt 28 outside working zone 36 defined between slide 22 and bolster 18.

Figure 2:
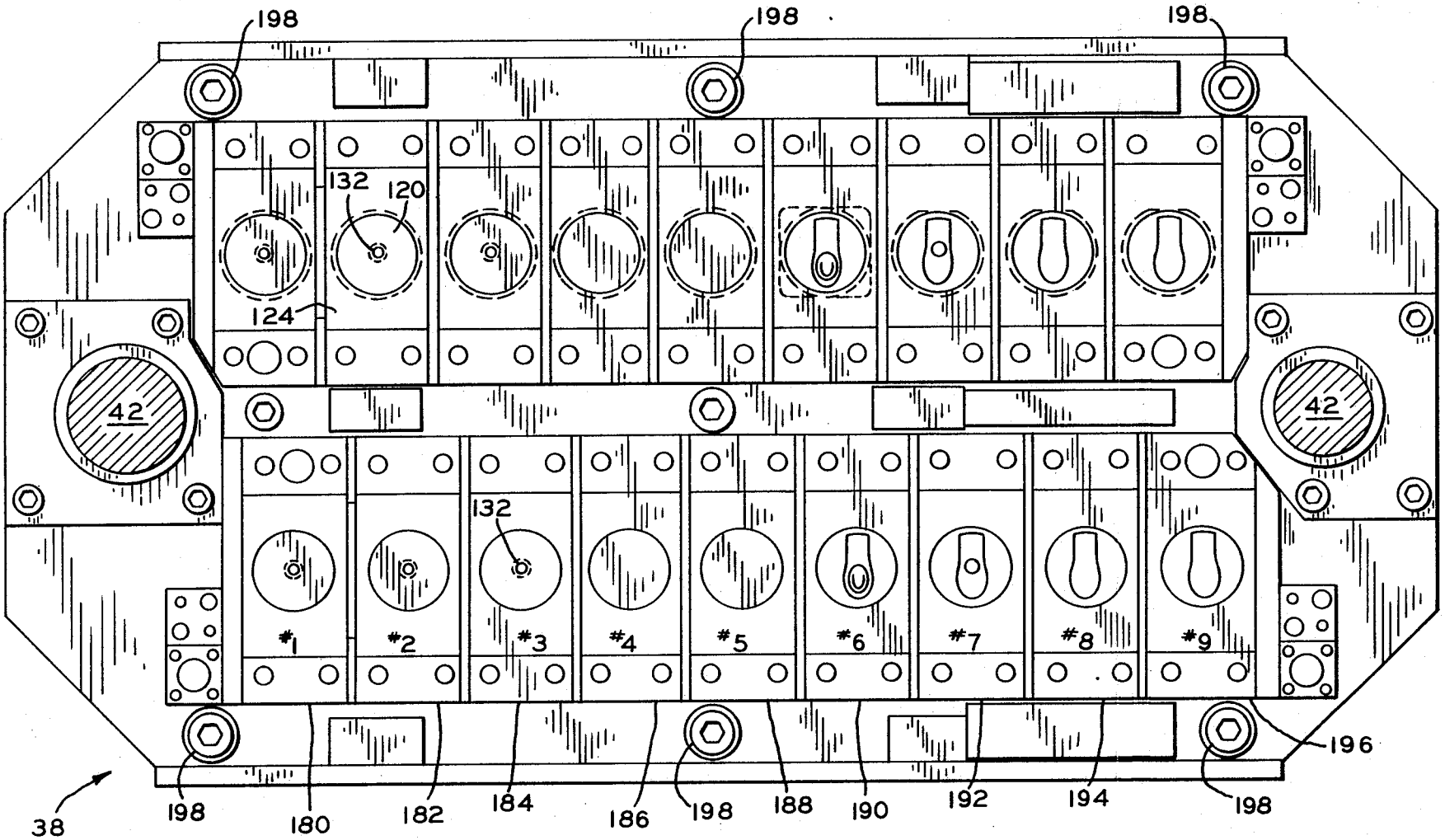
FIG. 2 is a top plan view of a dual-lane press lower die area for the forming of easy open can ends.

Main press 12 has lower tooling 38 mounted on bolster 18 within frame 16 and upper tooling 40 mounted on slide 22 in vertical alignment and defining therebetween working zone 36. FIG. 2 illustrates the tower tooling in a top view, as discussed below. This press assembly is merely an example of one which may be used in a particular embodiment of the present invention, but it is not a limitation.

Slide 22 may be mounted on guide posts, such as guideposts 23 that are rigidly connected to and extend downwardly from a connection to piston 76. Slide 22 is adaptable to move on guideposts 23 in a reciprocating manner in opening 36 between crown 20 and bolster 18 and between left and right upright pairs 44 and 46, respectively.

Drive assembly 26 has a crankshaft 48 with at least one eccentric 50 and is rotatably supported in main bearing blocks (not shown). The drive assembly further comprises clutch and brake elements operable with crankshaft 48 as known in the art. A flywheel 52 is rotatably mounted on crankshaft 48 and driven by flat belt 54. Belt 54 is disposed around motor pulley 56 driven by motor 58. When motor 58 is energized, flywheel 54 constantly rotates but does not drive crankshaft 48 until the clutch device 59 is engaged, at that time the friction disk of flywheel 52 is gripped and the rotational motion of flywheel 52 transmitted to crankshaft 48. A solid state limit switch 60 is driven by a pulley and belt arrangement 62 from the end of crankshaft 48 and controls various press functions, as known in the art.

Motor 58 is connected to crown cover plate 64 through mounting plate 66 by bolts and studs 68 with locknuts 70, 72 and 74. The tension on belt 54 can be varied by repositioning plate 66 on studs 68 by adjustment of locknuts 70 and 72 or studs 68.

Press 12 is dynamically balanced by known techniques to counteract the reciprocating movement of connection assemblies and slide 22 with a balancer weight connected to an eccentric similar to eccentric 50. Pistons 76 are operably connected to slide 22 and connecting arm 78, which is coupled to eccentric 50 and crankshaft 48.

Transfer conveyor 28 has a multi-lane continuous belt 80 operable between drive pulley 82 and idler pulley 84, the former being driven by a gear box. Belt 80 defines a horizontal plane 86 generally parallel to bed 14 and bolster 18 and has multiple workpiece carriers 81, which index through workstations in working zone 36 between tools 38 and 40. Belt 80 may include a series of holes engageable with sprocket teeth (not shown) on pulley 82 and 84 to index belt 80.

Tab press 30 includes a bolster 88 and slide 90. Lower tab tooling 89 is mounted on bolster 88 and upper tab tooling 91 is mounted on slide 90, with the tab press working zone defined therebetween. Tab press bolster 88 is generally parallel to plane 86 of conveyor 28. Slide 90 is operably connected to the tab press crankshaft 93. The tab press crankshaft is connected to crankshaft 48 through a universal joint 92, torque driveshaft 94, a second universal joint 96, a change direction gearbox 98 and a belt 100.

Main press 12, tab press 30, transfer conveyor 28, downstacker 32 and upstacker 34 are all synchronously operable in plane 86 with the reciprocation of slide 22 to index between the stations of tooling 38 and 40 within working zone 36.

Main press 12 and tab press 30 are independently adjustable, for example, the shutheight of each press can be independently adjusted by utilizing standard shutheight adjusting mechanisms. The shutheight, as applied to a vertical press, is the distance from the top of the bed to the bottom of the slide with the stroke down and the adjustment up. On moving bolster presses, the shutheight is measured from the top of the bolster, when it is integral with the carriage, or from the carriage, when the bolster is separate. The stroke lengths of the presses can be independently selected.

Figure 7:
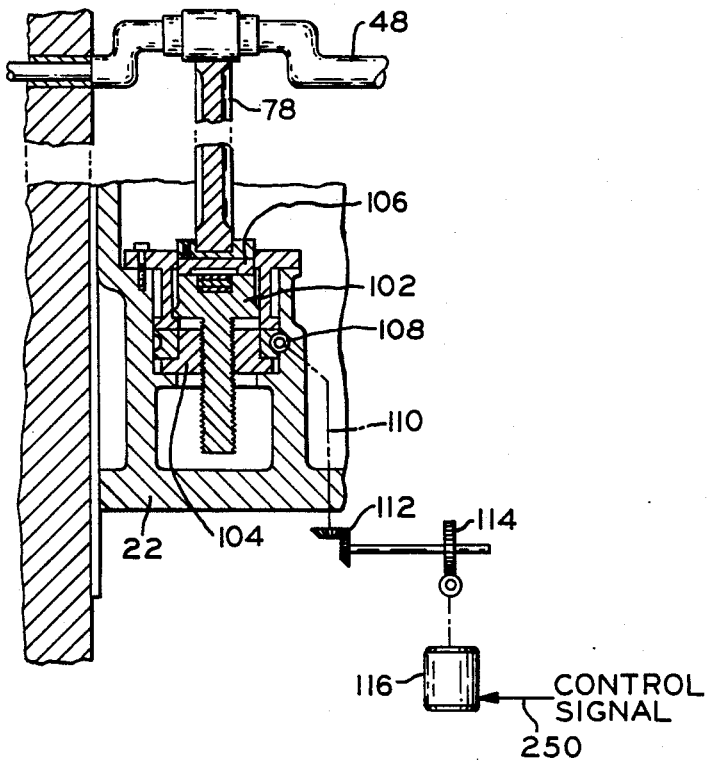
FIG. 7 is an elevational partial view of a press having an adjustable shutheight.

FIG. 7 illustrates an adjustable shutheight mechanism on the connection between the connecting rod 78 and slide 22. Screw 102 is threadedly engaged with nut 104, the latter being captured within slide 22. Screw 102 is connected to connecting rod 78 by means of pin 106 and moves in unison with connecting rod 78. In order to adjust the shutheight, nut 104 is rotated by worm gear 108, the latter being connected by means of linkage 110 and gears 112, 114 to stepper motor 116. As nut 104 is rotated, the axial distance between the slide face and the centerline of crankshaft 48 will be adjusted.

Figure 3:
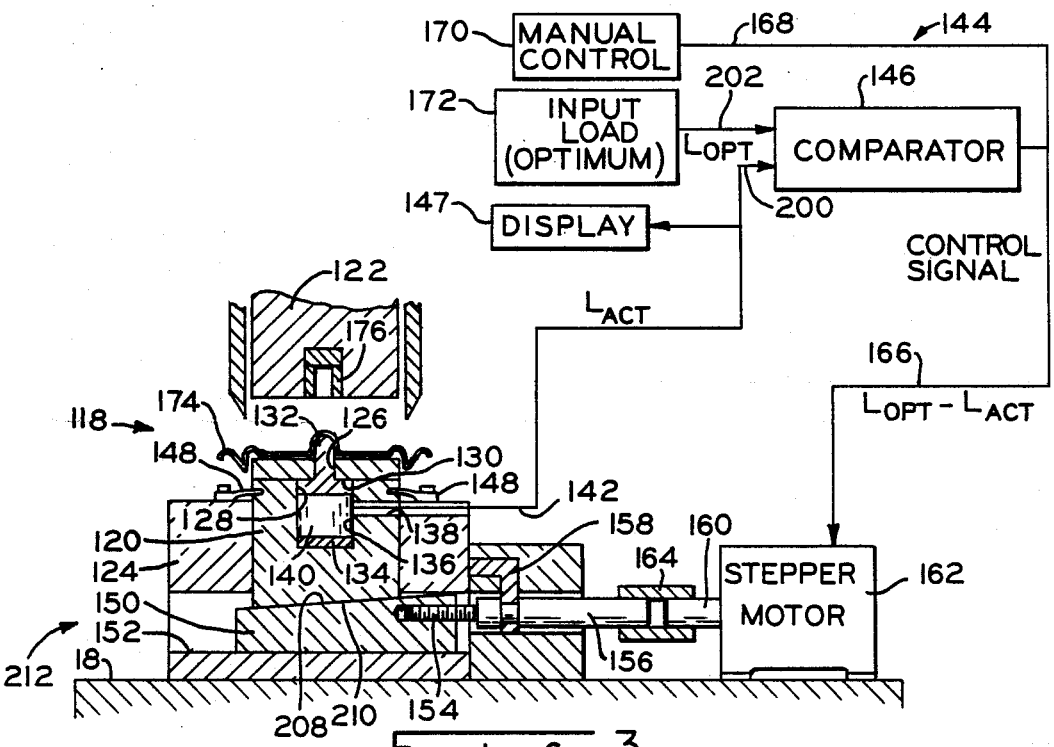
FIG. 3 is a sectional view of one of the tooling stations.

The present monitoring and feedback control system is operable to dynamically control the tool loading of a press assembly, such as press 10, during press operation, thereby maintaining the quality of the parts produced from the tooling within the specified manufacturing tolerances. More specifically, the tooling is dynamically adjustable, either manually or automatically, in response to tool loading, a line pressure and/or parts measurement and monitoring, through a feedback response circuit, which can provide continuous tool adjustment during press operation. Exemplary tooling arrangements for cooperation with the monitoring and feedback control system are shown in FIGS. 2–5. A control system or circuit 144, illustrated diagrammatically in FIG. 3, is provided to control the tooling.

A tool assembly 118 has a lower tool housing 120 and an upper tool housing 122. Lower tool housing 120 is mounted in lower tool retainer 124, which is mounted to bolster 18.

Lower tool housing 120 includes a bore 126 and a counterbore 128 with a shoulder 130 at their junction. Lower tool insert 132 is received and slidable in bore 126. A load transfer device 134, which may be a solid block, multiple blocks or shims or a preloaded spring, is positioned in counterbore 128.

Lower tool retainer 120 includes a chamber 136 and a channel 138 generally extending from chamber 136 to the exterior of retainer 124. A load cell or sensor 140 for sensing the tool load is mounted in chamber 136 with lead wires 142 extending from load cell 140 through channel 138 to a load control means 144 or a display 147. The load control means 144 may comprise a microprocessor, or a comparator 146 to receive input signals and provide output or control signals as a function of these inputs or it may be a calibrated display device 147. Load cell 140, for example a model ALD-W or an ALD-MINI-T by A. L. Design, Inc., is compressed between load transfer device 134 and tool 132, and is operable to provide an electrical input signal to circuit 144, $L_{act}$, indicative of the actual load on tool 132.

Lower tool housing 120 is clamped in place by means of clamps 148, which exert very stiff resilient downward force on lower tool housing 120. Small adjustments in the vertical position of lower tool housing 120 are effected by wedge member 150, which is slidably received within cavity 152, and is threadedly connected to the threaded forward portion 154 of lead screw 156. Lead screw 156 is held in place by shaft retainer 158, and is connected to the output shaft 160 of stepper motor 162 by coupling member 164.

Stepper motor 162 is controlled by the control signal output of comparator or microprocessor 146 on line 166. Alternatively, stepper motor 162 can be controlled by the output signal on line 168 from manual control 170. Input 172 is a reference signal transmitted by line 202 that relates to the optimum loading on lower tool 132 as workpiece 174 is deformed.

In FIG. 3, a forming operation utilizing upper tool 176 and lower tool 132 is illustrated with workpiece 174 interposed between tools 176 and 132. Upper tool 176 and lower tool 132 are operable by slide 22 and bolster 18, respectively, to form or partially form workpiece 174. The particular type of tooling shown in FIG. 3 is merely exemplary as it shows a particular step in the formation of a beverage can end. However, the invention is not limited to the specific structure of the tooling illustrated nor to the specifically discussed product.

A dual-lane press die arrangement is shown in FIG. 2, specifically a press arrangement for the formation of can ends. In this illustration, die tooling alignment guides 42 are located at either end of the tooling stations forming the die set, and lower tool housing 120 and lower tool insert 132 are shown. The lower tool and die arrangement is provided for multiple can end conversion operations, specifically: optional first station 180; second station 182, formation of a pre-bubble; third station 184, button forming and coining of area around the button; fourth station 186, incising, embossing and lane identification; fifth station 188, scoring the lid; sixth station 190, forming the panel beading and panel; seventh station 192, tab staking to the shell; eighth station 194, tab ear wipe down; and, optional ninth station 196, doming the lid. This particular arrangement is merely indicative of the type of tooling arrangement utilized for this particular forming operation. The various stations 180 to 196 will have different individual tools, however, the tool orientation or position for each tool will generally be the same within the die assembly. As can be appreciated, the stock material, such as a can end, is progressively moved in a transfer belt from at least the second to the seventh station (optionally from the first to the ninth station) for successive forming operations. The lower multiple tool and die assembly is secured by screws 198. Although the tooling for only a single station has been described above in FIG. 3, it is understood that each remaining station is provided with similar tooling for that station's particular forming operation. Each tool or die station is preferably provided with a separate, independent back-up load and control system, which is operable at the center of the load for each station, which is not necessarily the physical center of the station.

Control circuit 144 of FIG. 3 will be described wherein the tooling 132 and load cell 140 are in the lower tool arrangement. However, it is understood and appreciated that the alternative control arrangements noted above are operable with the control circuit with minor variations known in the art and the load cell 140 could be positioned in the upper tool assembly.

Conductor 142 from load cell sensor 140 is coupled to an optional signal display 147 for display of the load cell signal. Signal display 147 is calibrated as a function of the load on tool 132 to display the force load on the tool as sensed by sensor 140. The signal $L_{act}$ from load cell 140 is conducted to a controller 146 through lines 142 and 200. Controller 146, which is illustrated as a comparator, receives an input signal $L_{opt}$ on line 202, such as an optimum or desired input load, and the sensed load cell signal indicative of the actual tool load. Controller 146, which may be a comparator or a microprocessor, is operable to compare the desired input load signal and the actual tool load to communicate a control error signal through line 166 to stepper motor 162 or other controllable electro mechanical device. The optimal load signal on line 202 may be a predetermined value. Alternatively the load signal on line 202 may be a determinable calculated value or a pre-established load signature value correlated to previously known and acceptable quality production as a function of operating parameters such as temperature, speed or tool penetration. For example, visual inspection devices 206, such as diagrammatically illustrated in FIG. 6, or devices for measuring the penetration of the tool can also provide input signals to a microprocessor or controller, which can be programmed to interpret the input signals as corresponding to an acceptable or unacceptable part.

The microprocessor or comparator 146 will then provide an output signal ($L_{opt}-L_{act}$) to stepper motor 162 that will rotate lead screw 154 to laterally move wedge member 150. The cam surface 208 on wedge member 150 exerts force against cam surface 210 on lower tool retainer 120 to raise or lower tool retainer 120 by very small amounts. Although the solid tool back-up has been illustrated as a wedge member 150 that acts against the lower tool housing 120, any other mechanical variations of the vertical position of the lower tool 132 (or the upper tool 176 if the monitoring and adjustment mechanism is mounted in the upper tooling) can be utilized. For example, the lower tool could be supported on a block that is adjustable relative to the bolster through a screw mechanism.

Solid tool back-up mechanism 212 is responsive to the control signal to control the back-up load on tool 132. The back-up load and tool load are correlative values. Tool penetration into the stock material, and thus the energy required to form the finished product, are likewise related to the tool load. Therefore, feedback control of the tool load through the back-up load provides continuous control of tool penetration, which correlates to product quality. Continuous control of tool penetration obviates the necessity of utilizing overtravel and kiss blocks to maintain adequate tool penetration, to thus relieve the stress on the press and the necessity to provide excess energy for the part formation. Impliedly this will lead to the use of presses designed for lower tonnage (force) levels. As the tool load is continuously monitored throughout the operating cycle of the press the tool or tools will be continuously adjusted by adjustment of the back-up load without stopping the press. In addition, this tool variation will effectively adjust the shutheight for the selected individual tool or combination of tools. A manual override can, of course, be utilized by the operators for safety purposes, tool set-up, maintenance, etc., as known in the art.

Controller 146 can be a preprogrammed microprocessor capable of receiving an electrical signal through line 200 relating to sensed tool load. The microprocessor can determine an output control signal by various means, such as comparison of the sensed signal to a look-up table value with empirical data; by calculation of a desired tool load based on operating parameters; or by other analytic means. This desired control signal is compared to the actual load signal from monitor 147.

As indicated earlier, separate control and monitoring is provided for each of the die stations 180–196 within the die set so that individual adjustments can be made where necessary due to individual tool wear, part quality degradation at a particular forming station, etc. Each of the controllers illustrated in FIG. 3 could be replicated for the individual die stations, or a central microprocessor could be utilized to provide the monitoring and control function on a time division multiplex basis, if desired.

Although the automatic feed back control system is preferred, it is also possible to perform back-up load control by a manual technique wherein individual die stations are controlled independently. For example, a visual inspection of the part could indicate that one of the forming operations is out of specification, and the pressure for that particular die station can be increased or decreased as necessary to bring the forming step back into specification limits.

There are a number of parameters which can be monitored and utilized to provide back-up load adjustments or to produce error signals which automatically control the back-up force and thus product quality. Such parameters include the following:

(1) manual monitoring of part quality;

(2) video inspection monitoring of part quality;

(3) monitoring total tool load via press mounted strain instrumentation;

(4) monitoring individual tool station performance and load via strain instrumentation mounted in each station;

(5) monitoring individual tool station performance and load via piezoelectric instrumentation mounted in each station;

(6) monitoring individual tool station performance via hydraulic pressure monitoring;

(7) monitoring individual tool station performance via pneumatic or nitrogen pressure monitoring;

(8) monitoring individual tool station performance via vibration signal signature monitoring;

(9) monitoring individual tool station performance via acoustic emission signal monitoring;

(10) monitoring individual tool station performance via spectral signal analysis;

(11) monitoring total tool load via die subplate mounted instrumentation;

(12) monitoring individual tool load and total tool load via die subplate with individual movable stations strain or piezoelectric instrumentation;

(13) monitoring of tool setup via strain gauged kiss blocks; and

(14) monitoring of critical tool station setup and performance via individual tool station kiss blocks which are strain gauged or otherwise instrumented.

Figure 4:
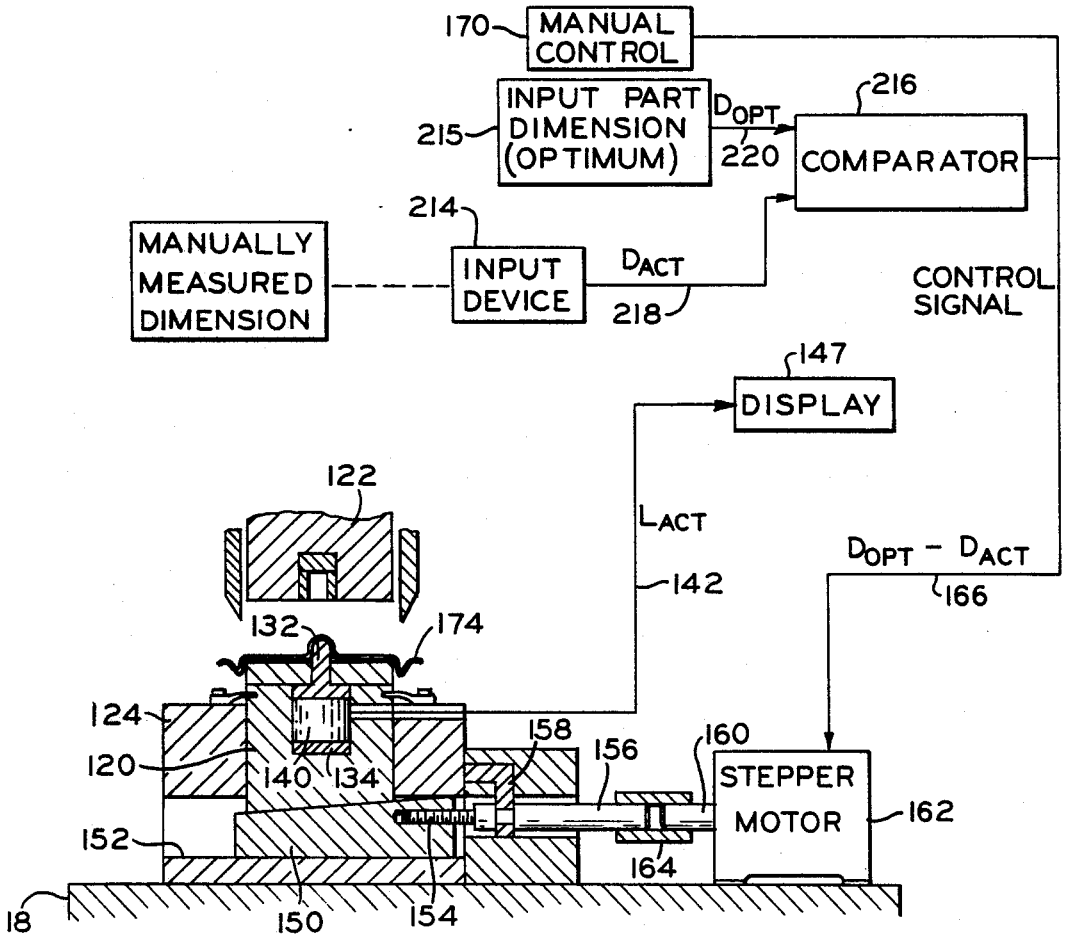
FIG. 4 is a view similar to FIG. 3 showing a modified monitoring and control system.

Another embodiment of the control system, as shown in FIG. 4, provides an input device 214, such as a CRT and keyboard, which receives manually measured dimensional data for individual parts. The measured dimensions $D_{act}$ are provided to controller 216 over line 218. An input dimension signal $D_{opt}$, which is indicative of the optimal or desired dimension correlative to acceptable tool penetration and thus quality part production, is communicated to controller 216 through line 220. Controller 216 could again be a comparator for receiving multiple input signals for comparison with the actual signal and for determination of an output control signal communicated to motor 162 through line 166. Wedge 150 is thus varied in response to the control signal to control the back-up load on tool 132.

Figure 6:
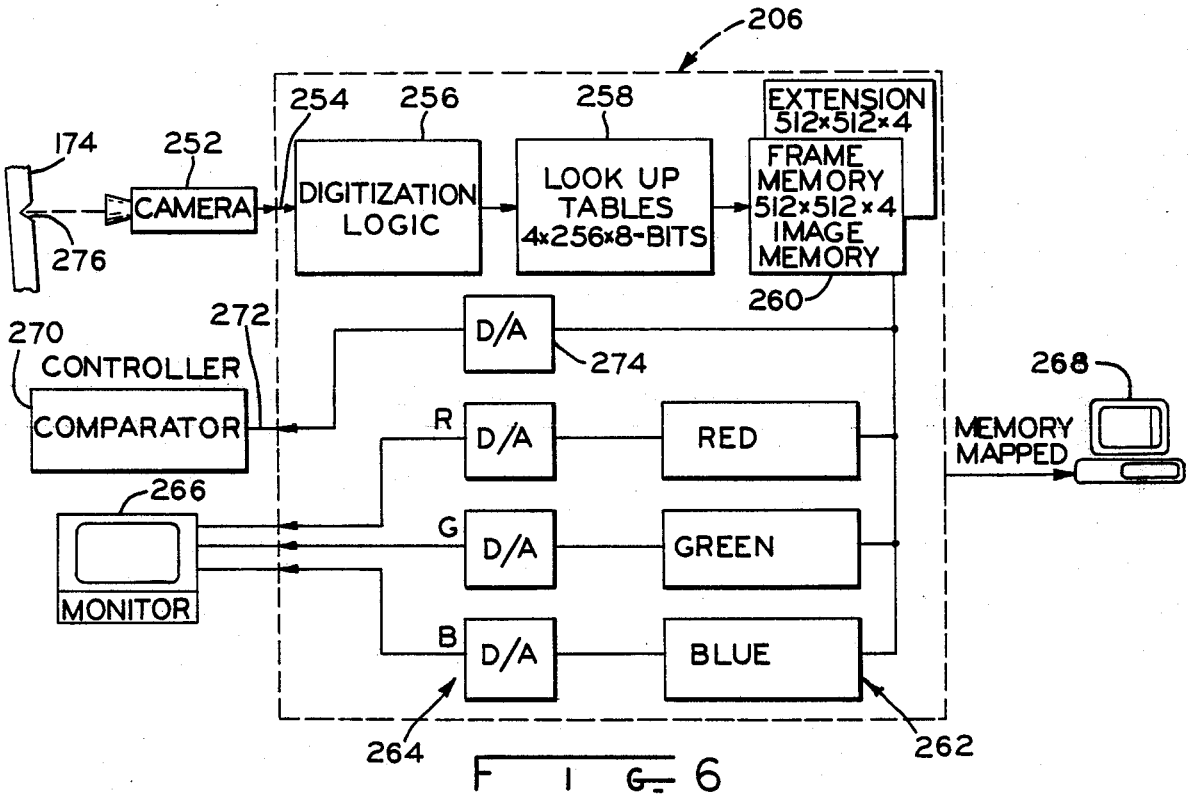
FIG. 6 is an exemplary diagrammatic arrangement of an automatic dimensional monitor system useable with the present invention.
Figure 5:
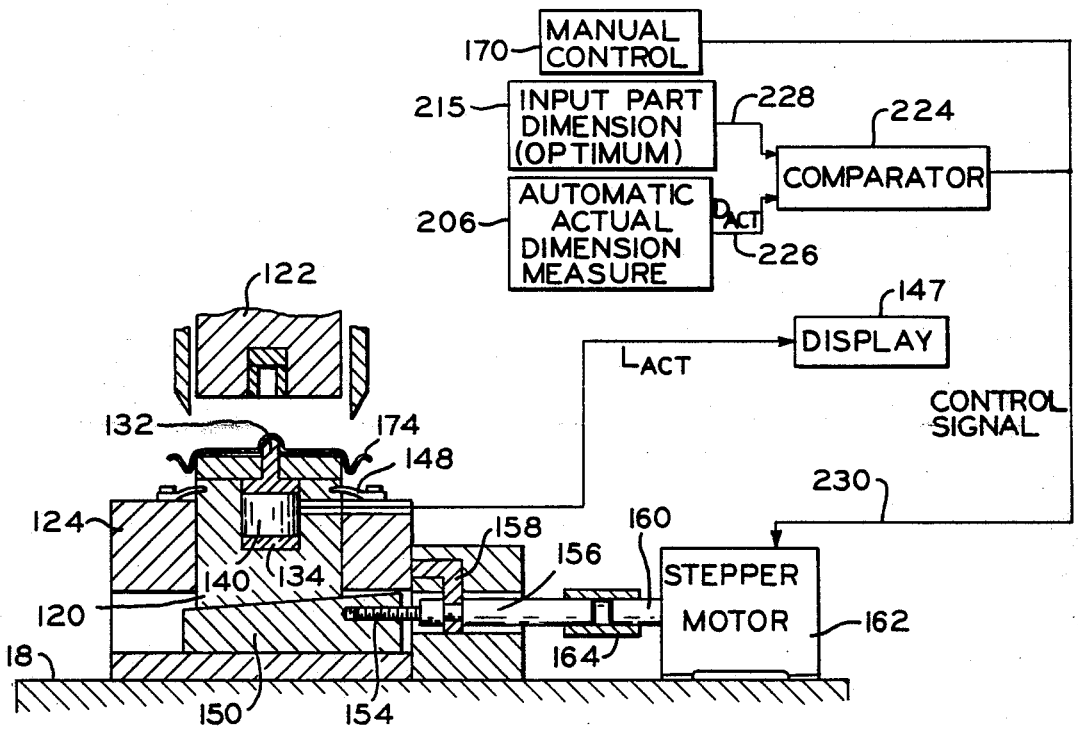
FIG. 5 is a view similar to FIG. 3 showing a further modified monitoring and control system.

FIG. 5 illustrates a further embodiment of the above-noted control system, which provides an automatic part dimension measurement device 206, such as a video inspection device, a fiber optic inductive copactive or x-ray sensor, as illustrated in FIG. 6 to be described hereinafter, operable to provide an actual dimension input signal $D_{act}$ to comparator 224 through line 226. An input dimension signal, which is indicative of the optimal or desired dimension, is again communicated to controller 224 throughline 228. The part dimension signals from devices 215 and 206 above in FIGS. 4 and 5, respectively, are provided to controller 224. As noted above, controller 224 could be a comparator for comparison of the actual signal (part dimension) to the desired input signal (desired or optimal part dimension). Motor 162 is coupled to comparator 224 to receive a control signal through line 230. Wedge 150 is again varied by comparator 224 to control the back-up load on tool 132.

Rather than monitoring each die station individually and adjusting the back-up load for that particular station, a critical station can be monitored and then the entire shutheight of the press modified to bring the critical station into compliance. For example, the fifth station 188 (FIG. 2), which scores the lid, is a particularly critical operation in a conversion press because if the score line is too deep, the lid will leak, and if the score line is too light, the tear-away portion of the lid cannot be removed. Any of the monitoring arrangements illustrated in FIGS. 3, 4 and 5 may be utilized to monitor a particularly critical dimension or the back-up load at a particularly critical station, and the error output from the comparator or microprocessor can be connected over a line 166 to stepper motor 162. This will control the amount of press shutheight as described earlier, thereby varying the load on all of the die stations, including the critical station that is being specially monitored.

Figure 8:
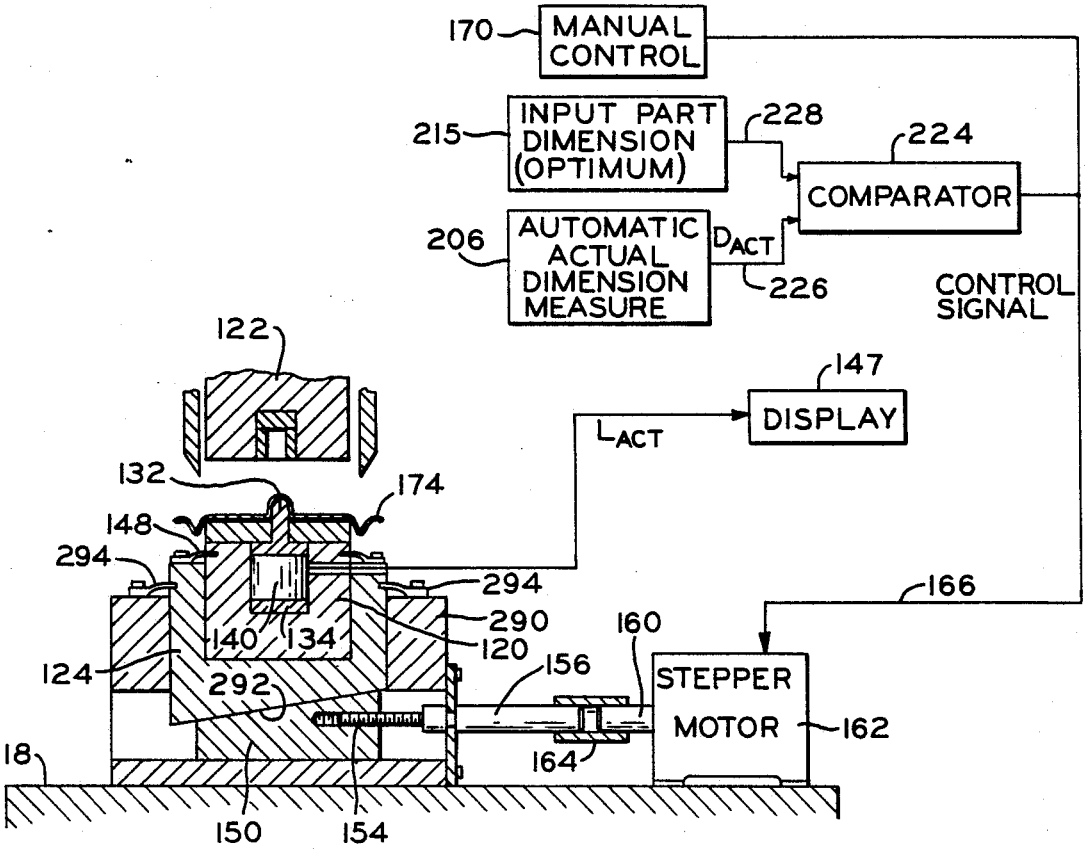
FIG. 8 is a sectional view of one of the tooling stations including a mechanism for adjusting the shutheight of the press.

FIG. 8 illustrates an arrangement whereby the entire shutheight of the press can be changed by the monitoring and control system of the present invention. In this arrangement, lower tooling retainer 124 is common to all of the lower tool holders 120 for all of the die stations illustrated in FIG. 2, and lower tool retainer 124 is received within lower tooling block 290 supported on bolster 18. Wedge member 150, which is actuated by stepper motor 162 as described above, acts against the cam surface 292 of tool retainer 124 so that all of the lower tooling stations 180-192 are raised or lowered, or preloaded, in unison. Lower tool retainer 124 is connected to tooling block 290 by means of clamps 294, for example. Alternatively, a wedge member or other solid adjustable back-up device could be mounted beneath lower tooling block 290.

Depending on the output signal on line 166 to stepper motor 162, the entire lower tooling will be raised or lowered to thereby adjust the press shutheight. This action can be controlled by monitoring a single tool station or a plurality of tool stations to ensure that certain critical parameters are met.

The action of wedge member 150 on either lower tool holder 120 (FIGS. 3-5) or on lower tool retainer 124 (FIG. 8) may adjust the shutheight of the entire press or the shutheight of individual stations. Alternatively, this may serve to elastically deform the lower tooling to increase the preload force on the lower tooling thereby causing greater tool penetration during actuation of the press. The increased force can also preload the load transfer device 134, which may be a preloaded spring.

FIG. 6 diagrammatically illustrates an apparatus utilized to monitor or measure a part dimension. This particular apparatus, which is merely exemplary and not a limitation, is available from Imaging Technology, Inc. under the designation IMAG 100 series real time image processor. These image processing devices include processing functions including thresholding, histogram equalization, plotting, stretching and logical and arithmetic operations and provide analog or digital outputs indicative of dimensional measurements. Software packages are available to provide graphic arts, auto cad and advanced mathematic functions with an array processor. This disclosure is provided to illustrate the availability of such automatic dimensional measuring apparatus and it is known that alternative assemblies are available to perform these functions. As shown, the system 206 in FIG. 6 provides a camera 252 to sense a particular dimension of a part 174, which camera 252 provides a sensed parameter signal on line 254 to a circuit which includes digitization logic circuit 256, look up tables 258, image memory 260, color module 262 and digital to analog converters 264 to provide an output signal or signals to a monitor 266. In addition, the circuit may be coupled to a remote display device 268 for memory mapping. The signal within circuit 206 may be coupled to the controller 270 through line 272 and the digital/analog converter 274 to provide an output control signal correlated to represent the dimension sensed by camera 252, for example, the depth of score 276 on can end 174.

While only certain embodiments of the invention have been described and claimed herein, it is apparent that various modifications and alterations of the invention may be made. It is therefore the intention in the appended claims to cover all such modifications and alterations as may fall within the true spirit and scope of the invention.

What is claimed is:

1. A method of monitoring and controlling a back-up load to at least one of an upper and lower tool in a press during the actuation of the tools on a workpiece comprising:

applying a variable back-up force to the one tool wherein the back-up force is effected at least during tool actuation, sensing the back-up load at said one tool during actuation of the tools on the workpiece and producing a signal correlated to the sensed load;

comparing a predetermined reference load signal and said sensed signal and producing an output control signal as a function of said compared signals; and controlling, in response to said control signal, the back-up load on said one tool by adjusting the position of a solid, non-fluid back-up element to increase or decrease resistance in a direction opposite to the direction of force applied by the other tool.

2. In a press having a slide and bolster to which is attached tooling comprising a plurality of die stations, each die station performing a separate forming operation on a workpiece passing through the press, a method of controlling quality of the formed workpiece comprising:

sensing the individual loads on the tooling in each of the die stations as the press is running and providing an indication of such loads, comparing the sensed loads with desired loads, and while the press is running, modifying the back-up loads applied to those die stations where the sensed loads differed from the desired loads to achieve desired load conditions by adjusting the position of a solid non-fluid back-up element to increase or decrease resistance in a direction opposite to the direction of force applied to the tooling during actuation of the press, the back-up loads for the die stations being modified independently of each other.

3. In a press having a slide and bolster to which is attached tooling comprising a plurality of die stations, each die station performing a separate forming operation on a workpiece passing through the press, a method of controlling quality of the formed workpiece comprising:

sensing the values of a plurality of predetermined dimensional parameters of the workpiece formed by the tooling that vary depending on the amount of force exerted on the workpiece by the tooling at the respective die stations, comparing the sensed parameter values with desired parameter values, and while the press is running, modifying the back-up loads applied to those die stations where the sensed parameter values differ from the desired parameter values to achieve desired parameter values by adjusting the position of a solid, non-fluid back-up element to increase or decrease resistance in a direction opposite to the direction of force applied to the tooling during actuation of the press, the back-up loads for the die stations being modified independently of each other.

4. A method for monitoring and controlling a back-up load to a back-up load means with at least one of an upper tool and lower tool in a press assembly, said back-up load means including a tool support, said upper tools and lower tools cooperating to define the shutheight therebetween, said method comprising:

exerting a variable force on the tool support to thereby provide a back-up load to said tool support;

sensing the back-up load at said at least one of an upper tool and lower tool as the tools form a workpiece and producing a signal correlated to the sensed load;

comparing a predetermined reference load signal and said sensed signal and producing an output control signal as a function of said compared signals; and utilizing said output control signal to control automatically the variable force and the tool back-up load to elastically deform said tool support thereby varying said shutheight to thus control said tool load during forming of the workpiece.

5. The method of claim 4 wherein the press tooling comprises a plurality of die stations that perform different forming operations on the workpiece and including:

sensing a plurality of parameters of the workpiece that vary depending on the force exerted on the workpiece at the respective die stations, and independently controlling the back-up loads at the die stations in response to the sensed parameters.

6. The method of claim 5 wherein the step of controlling comprises manually adjusting back-up force to the tooling.

7. A method for monitoring and controlling a back-up load to a tool means in a pres having a plurality of upper tools and a plurality of lower tools and a tool support having one of said plurality of upper and lower tools mounted thereon in a press assembly, said method comprising:

applying mechanical back-up force to said tool support to provide a back-up load to said plurality of tools thereon, the mechanical back-up force being applied by adjusting the position of a solid, non-fluid back-up element to increase or decrease resistance in a direction opposite the direction of force applied by the other tools;

sensing the back-up load at least at one of said tools and producing a signal correlated to the sensed load;

providing a display device;

comparing a predetermined reference load signal and said sensed signal and, producing and displaying an output control signal on a display device as a function of said compared signals; and controlling said mechanical back-up force and said tool back-up load in response to said control signal.

8. In a press having a plurality of upper tools and lower tools, for performing forming operations on a workpiece passing through the press, which upper tools and lower tools define a shutheight therebetween, and a tool support, a method for controlling the shutheight and thus the back-up force applied to the workpiece, said method comprising:

applying a controllable mechanical back-up force to said tool support during the forming operations on said workpiece;

sensing a predetermined parameter of the workpiece formed by the tooling that varies depending upon the amount of force exerted on the workpiece by the tooling; producing a sensed back-up load signal indicative of the force exerted on the workpiece that correlates to the value of the sensed parameter;

comparing the back-up load signal with a reference signal indicative of a back-up load correlative to a desired value of said parameter; producing and displaying an output control signal indicative of said compared signals; and varying said mechanical back-up force applied to said tool support to elastically deform said support thereby varying said shutheight and thus said back-up load at said tools.

* * * * *